United States Patent [19]

Mishel

[11] 4,184,679

[45] Jan. 22, 1980

[54] GAME RACKET AND METHOD OF MAKING SAME

[76] Inventor: Madeline H. Mishel, 126 E. 79th St., New York, N.Y. 10021

[21] Appl. No.: 884,481

[22] Filed: Mar. 8, 1978

Related U.S. Application Data

[63] Continuation of Ser. No. 718,875, Aug. 30, 1976, abandoned.

[51] Int. Cl.[2] ..... A63B 51/08

[52] U.S. Cl. ..... 273/73 D

[58] Field of Search ..... 273/73 R, 73 A, 73 C, 273/73 D, 73 E, 73 F, 73 G, 73 H

[56] References Cited

U.S. PATENT DOCUMENTS

| | | | |
|---|---|---|---|
| D. 217,824 | 6/1970 | Carlton | 273/73 C |
| 323,608 | 8/1885 | Turner | 273/73 D |
| 971,773 | 10/1910 | Mueller | 273/73 D |
| 1,470,878 | 10/1923 | Robinson | 273/73 D |
| 4,131,279 | 12/1978 | Ogden | 273/73 D |

FOREIGN PATENT DOCUMENTS

| | | | |
|---|---|---|---|
| 550985 | 12/1922 | France | 273/73 D |
| 5177 | of 1885 | United Kingdom | 273/73 D |
| 16414 | of 1891 | United Kingdom | 273/73 D |
| 10851 | of 1907 | United Kingdom | 273/73 D |
| 224,964 | 11/1924 | United Kingdom | 273/73 D |
| 287,775 | 3/1928 | United Kingdom | 273/73 D |
| 362,036 | 12/1931 | United Kingdom | 273/73 D |
| 451,384 | 8/1936 | United Kingdom | 273/73 D |
| 566,130 | 12/1944 | United Kingdom | 273/73 D |

*Primary Examiner*—Richard J. Apley

[57] ABSTRACT

A game racket of the type used to play games such as tennis, squash, badminton, or other games includes a frame having a handle with an open head at one end. Three sets of strings are strung through the head in a pattern which forms a network across the head. Two of the sets of strings are obliquely oriented with respect to the longitudinal axis of the handle while the third set of strings is oriented parallel to the longitudinal axis of the handle in one embodiment of the invention and perpendicular to the longitudinal axis of the handle in another embodiment of the invention. Also presented is a method of manufacturing the racket of the present invention.

14 Claims, 10 Drawing Figures

GAME RACKET AND METHOD OF MAKING SAME

CROSS REFERENCE TO RELATED APPLICATIONS

This application is a continuation of application with Ser. No. 718,875 filed Aug. 30, 1976, now abandoned.

BACKGROUND OF THE INVENTION

The present invention relates to games rackets of the type which are used to play tennis, squash, badminton, and other racket games.

While the present invention may be employed in a wide variety of rackets of the type used to play such games as tennis, squash, badminton, and the like, reference herein will be made to oval headed rackets, such as tennis rackets, and to circular headed rackets, such as squash rackets, although such reference is meant to include rackets of the type used for playing other games as well.

Tennis rackets generally comprise a frame including a handle made of metal or wood having a grip attached at one end and a substantially oval head attached at the other end. A netting, generally of nylon or catgut, is stretched across the head, with the most common form of netting comprising a set of strings extending in a direction parallel to the longitudinal axis of the handle (hereinafter referred to as being in the vertical direction) with a second set of strings extending in a direction perpendicular to the longitudinal axis of the handle (hereinafter referred to as being in the horizontal direction). Generally, the horizontal and vertical strings are weaved together such that any horizontal string will overlie and underlie any two adjacent vertical strings, and any vertical string will overlie and underlie any two adjacent horizontal strings.

There have been rackets made heretofore which have employed netting patterns including sets of strings going other than in the standard horizontal and vertical patterns. For example, in U.S. Pat. No. 1,687,322 entitled GAMES RACKET which issued on Oct. 9, 1928 to C. A. Claremont, a racket is described which employs wire stringing in a racket having an elastic rim. The wire stringing of the racket described by Claremont is in a diagonal pattern in which two sets of parallel strings are interlaced with each other and all of the strings are skewed with respect to the longitudinal axis of the handle.

Another tennis racket which employs two sets of interlaced diagonal strings is described in U.S. Pat. No. 3,917,267 entitled TENNIS RACKET which issued on Nov. 4, 1975 to C. A. McGrath. In the racket described in the patents issued to Claremont and to McGrath two sets of interlaced diagonal strings were used, where the term "diagonal" is used to mean the direction of the strings is oblique to the longitudinal axis of the handle and the term "interlaced" is used to mean that adjacent strings of one set of strings are alternately weaved above and below adjacent strings of the other set of strings.

In British Pat. No. 5177 entitled IMPROVEMENTS IN THE METHOD OF STRINGING LAWN TENNIS, RACQUET, AND OTHER BATS which issued on Jan. 27, 1886 to W. D. Nightingale, a tennis racket is described which employs three sets of strings, two sets being diagonal and the third set being horizontal. When the racket is viewed from the front, all of the strings of one of the diagonal sets overlie all of the strings of the other diagonal set. The strings of the horizontal set are weaved through the two diagonal sets in a pattern in which the horizontal strings overlie all of the strings of the upper diagonal set and underlie all of the strings of the lower diagonal set. In addition, none of the intersections of the horizontal strings with the strings of either of the diagonal set coincides with an intersection of a diagonal string from one diagonal set with a diagonal string from the other diagonal set.

A problem which has been observed with the tennis racket described by Nightingale which employed 20 horizontal strings and 18 strings in each diagonal is that if the strings are tensioned in a normal range of from 40 to 75 pounds, the racket will not play well. It has been found that the poor play of the racket described by Nightingale results from the large number of strings which he employed.

SUMMARY OF THE INVENTION

A first embodiment of a racket is presented which employs two sets of diagonal strings and one set of interlaced vertical strings.

The method of making the first embodiment is also presented and comprises the steps of first stringing the vertical strings and then alternately stringing the strings of each diagonal.

A second embodiment of the invention comprises a racket which employs two sets of diagonal strings and one set of interlaced horizontal strings. The number of strings in the horizontal set is between 9 and 16, and the product of the total number of strings in the three sets times the tension of the strings is between 900 and 2900 pounds.

DETAILED DESCRIPTION OF THE INVENTION

Figure 1:
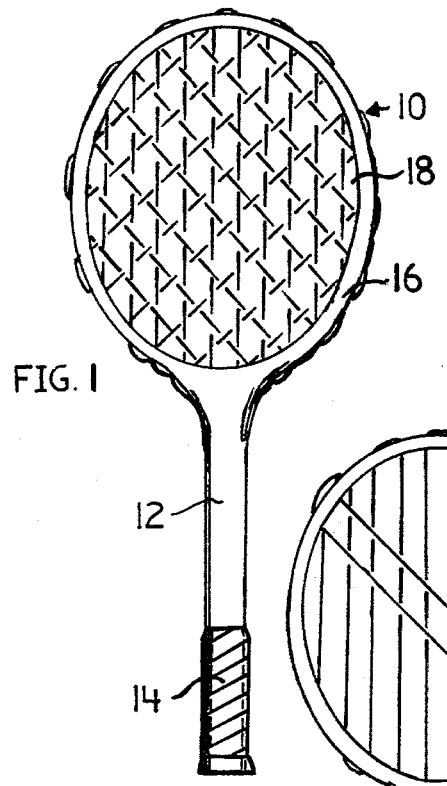
FIG. 1 is a front view of a tennis racket which employs the preferred embodiment of the present invention.

Referring generally to FIG. 1, the preferred embodiment of the tennis racket of the present invention is shown. The racket 10 comprises a handle 12 having a grip 14 at one end. The frame of the racket 10 may be constructed of any suitable material, such as wood or metal. Both wood and metal framed rackets have been constructed in accordance with the invention and rackets made of either material have been found to play superior to rackets having wood or metal frames which did not incorporate the present invention.

The racket 10 has an open head 16 which is generally substantially oval in the case of a tennis racket but which would generally be circular in the case of a squash racket. The head 16 is at the end of the handle 12 disposed remote from the grip 14. The head 16 has a network of three sets of strings 18 which extend across it. The strings in each set are substantially parallel to each other, with the strings of the first set being substantially parallel to the longitudinal axis of the handle 12.

The second set of strings is obliquely oriented with respect to the first set of strings in one direction, and the third set of strings is obliquely oriented with respect to the first set of strings in the other direction. The angle between the second and third sets of strings is substantially double the angle between the first set of strings and either the second or the third set of strings.

In the preferred embodiment of the invention, the first set of strings or the vertical strings is comprised of from 9 to 16 strings in an oval headed racket, such as a tennis racket, and from 9 to 16 strings in a circular headed racket, such as a squash racket. The number of strings in the second and third sets, i.e. the diagonal sets, are chosen to be equal to one another and to be between 9 and 20 strings in an oval headed racket and between 9 and 16 strings in a circular headed racket.

The tension chosen for the strings is preferably selected to vary inversely with the number of strings in the racket and to be between about 40 pounds in an oval headed racket having 12 vertical strings and 20 strings in each diagonal and about 75 pounds in an oval headed racket having 10 vertical strings and 9 strings in each diagonal. For a circular headed racket, the tension is chosen to be between about 25 pounds for a racket having 14 vertical strings and 14 strings in each diagonal and 55 pounds for a racket having 9 vertical strings and 9 strings in each diagonal. Reference to TABLE I below will provide a more complete indication of the relationship between the number of strings and the tension range (in pounds) for an oval headed racket made in accordance with the preferred embodiment of the invention, and reference to TABLE II below will provide a more complete indication of the relationship between the number of strings and the tension range (in pounds) for a circular headed racket made in accordance with the preferred embodiment of the invention.

TABLE I

| | Oval Headed Racket | |
|---|---|---|
| No. of Vertical Strings | No. of Strings in Each Diagonal | Tension Range (pounds) |
| 9 | 9 | 50–75 |
| 10 | 9 | 60–75 |
| 10 | 10 | 60–75 |
| 11 | 11 | 60–75 |
| 12 | 12 | 50–70 |
| 12 | 20 | 40–60 |
| 13 | 13 | 50–60 |
| 14 | 14 | 40–60 |
| 16 | 14 | 40–60. |

TABLE II

| | Circular Headed Racket | |
|---|---|---|
| No. of Vertical or Horizontal Strings | No. of Strings in Each Diagonal | Tension Range (pounds) |
| 9 | 9 | 40–55 |
| 10 | 10 | 35–55 |
| 11 | 11 | 30–50 |
| 12 | 12 | 30–50 |
| 14 | 14 | 25–50 |
| 16 | 14 | 25–50 |

Figure 2:
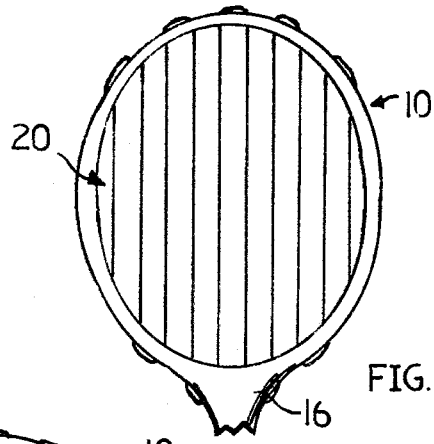
FIGS. 2–5 are front views showing the method of stringing the racket of FIG. 1.

Referring now to FIGS. 2–5, the method of stringing the racket 10 of the preferred embodiment will be explained. First, all of the vertical strings 20 are strung through the head 16, as shown in FIG. 2. This is accomplished in the standard manner using standard racket stringing equipment.

Figure 3:
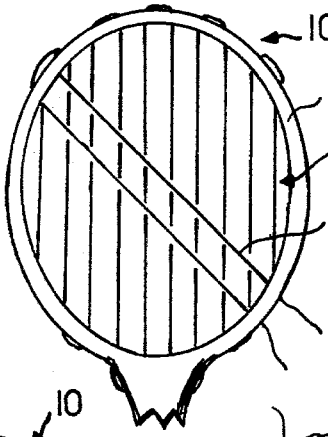

After all of the vertical strings 20 are in place, two diagonal strings from the second set of strings 22 are strung through the head 16 of the racket 10, as shown in FIG. 3. These diagonal strings 22 of the second set overlie all of the vertical strings 20. During the stringing operation the diagonal strings 22 are held in place by awls (not shown) under tension in the standard manner.

Figure 4:
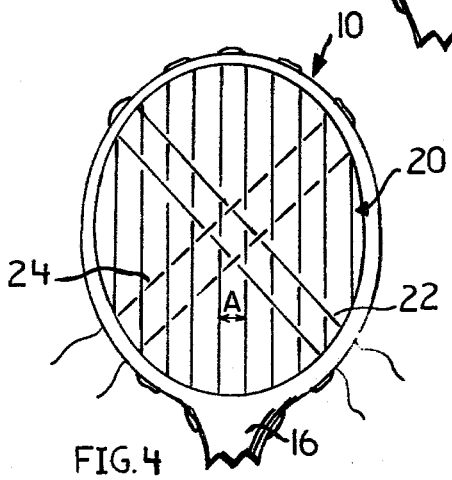

Next, with reference to FIG. 4, two diagonal strings 24 from the third set of strings are strung through the head 16 of the racket 10. The diagonal strings of the third set are woven through the vertical strings 20 and the diagonal strings 22 of the second set such that they underlie all of the vertical strings 20 and overlie all of the diagonal strings 22 of the second set.

Due to this overlying and underlying weaving pattern, when strings intersect, they force themselves to cross midway between adjacent parallel strings of the set of strings which contains neither intersecting strings. Strings are actually forced to go to the position of lowest potential energy, which occurs at the midpoint of the distance between the adjacent parallel strings. Refer to new letters A on FIG. 4.

This forcing of the strings to cross each other at the midpoint of the distance between adjacent parallel strings is backed by a law of physics which states that a physical system (in this case, it is the intersection of two tensioned strings) always tries to go to the point of least potential energy.

Since this happens at all intersections, a symmetry is created in the pattern, which results in the strings of the pattern being substantially uniformly spaced within each respective set of strings.

Figure 5:
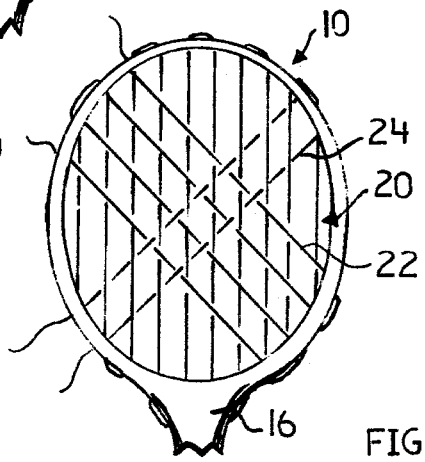

With reference now to FIG. 5, additional diagonal strings 22 from the second set of strings are strung through the head 16 of the racket 10. They are woven through the vertical strings 20 and the diagonal strings 24 of the third set such that they overlie all of the vertical strings 20 and underlie all of the diagonal strings 24 of the third set.

The process of weaving two diagonal strings 22 of the second set, then two diagonal strings 24 of the third set is continued until the head 16 of the racket 10 has been completely strung as shown in FIG. 1.

Figure 6:
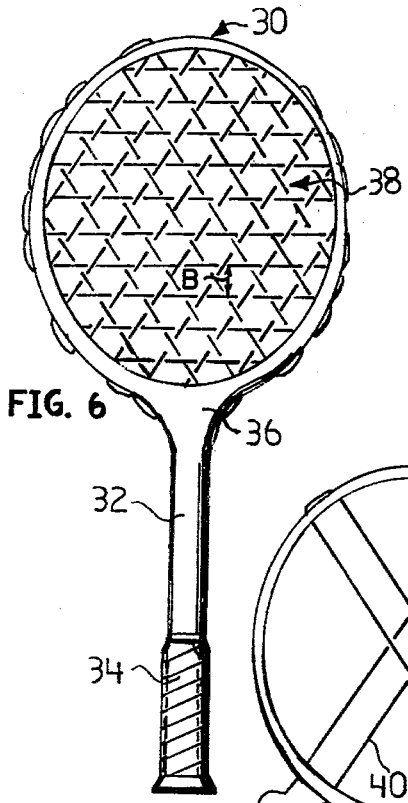
FIG. 6 is a front view of a second embodiment of the present invention.

Referring now to FIG. 6, a second embodiment 30 of the racket of the present invention is shown. The racket 30 is comprised of a handle 32 having a grip 34 attached at one end and an open head 36 which is substantially oval in the case of a tennis racket but which would generally be circular in the case of a squash racket. A network of three sets of strings 38 extend across the head 36. The strings in each set are substantially parallel to each other, with the strings of the first set being horizontal, i.e. perpendicular to the longitudinal axis of the handle 32. The second and third sets of strings are each diagonal as in the first embodiment of the invention.

The tension chosen for the strings is selected to vary inversely with the number of strings in the racket and to be between about 40 pounds in an oval headed racket having 14 horizontal strings and 14 strings in each diagonal and about 75 pounds in an oval headed racket having 10 horizontal strings and 8 strings in each diagonal. Reference to TABLE III below will provide a more complete indication of the relationship between the number of strings and the tension range (in pounds)

for an oval headed racket made in accordance with this embodiment of the invention.

TABLE III

| No. of Horizontal Strings | Oval Headed Racket: No. of Strings in Each Diagonal | Tension Range (pounds) |
|---|---|---|
| 9 | 8 | 60–75 |
| 10 | 9 | 60–75 |
| 10 | 10 | 60–75 |
| 11 | 11 | 40–65 |
| 12 | 10 | 50–75 |
| 12 | 12 | 40–65 |
| 13 | 13 | 40–65 |
| 14 | 12 | 60–75 |
| 14 | 13 | 40–65 |
| 14 | 14 | 40–65 |
| 16 | 18 | 40–55 |

Circular headed rackets are symmetrical. Accordingly, TABLE II provides an indication of the relationship between the number of strings and the tension range (in pounds) for a circular headed racket made in accordance with this embodiment of the invention. It should be remembered, however, that the above tables are provided merely to give an indication of the relationship between the number of strings and the tension range which may be used in manufacturing the rackets of the present invention, and it is possible to manufacture rackets in accordance with the invention which have relationships between the number of strings and the tension range other than those which are particularly listed in one of the tables.

Figure 7:
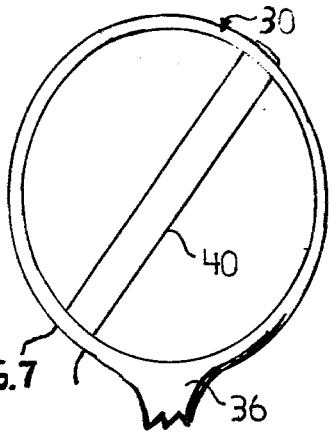
FIGS. 7–10 are front views showing the method of stringing the racket of FIG. 6.
Figure 8:
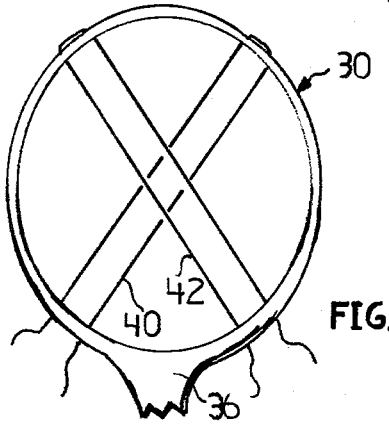

In order to string a racket in accordance with this embodiment of the invention, one starts by stringing two diagonal strings 40 from the second set of strings as shown in FIG. 7. Next, two diagonal strings 42 from the third set of strings are strung through the frame as shown in FIG. 8. These two diagonal strings 42 from the third set overlie the first two diagonal strings 40 from the second set. Each of the strings is pulled to the appropriate tension and is held in position by an awl in the standard member during the stringing operation.

The steps described above are continued, with the addition of two diagonal strings 40 of the second set followed by two diagonal strings 42 of the third set until the head 36 has been strung with the desired number of diagonal strings 40, 42. At that point all of the diagonal strings 40 of the second set will underlie all of the diagonal strings 42 of the third set as shown in FIG. 9.

Figure 9:
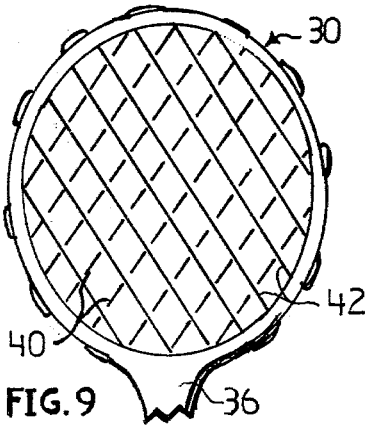
Figure 10:
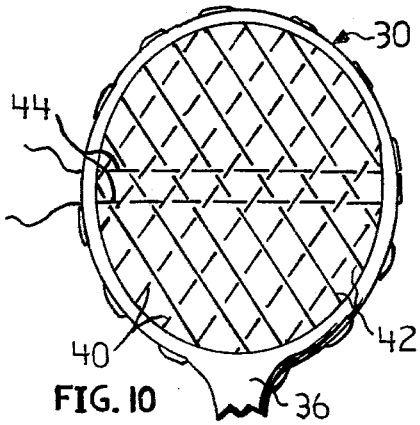

After all of the diagonal strings 40, 42 are in place as shown in FIG. 9, the horizontal strings 44 are woven into place starting at the center of the racket 30, as shown in FIG. 10. The horizontal strings 44 are interwoven with the diagonal strings 40, 42 such that the horizontal strings 44 underlie all of the strings 40 of the second set of diagonals and overlie all of the strings 42 of the third set of diagonals. After the horizontal strings 44 in the center of the racket 30 are in place, additional horizontal strings are added to the racket 30 above and below those in the center until the racket 30 is completely strung, as shown in FIG. 6.

An important feature of the present invention is the inverse relationship between the number of strings and the tension of the strings. The reason for the importance of that relationship is that a racket which has a large number of strings as well as a high tension is extremely stiff while a racket which has a small number of strings and a low tension is very loose. In order to provide a properly resilient racket it has been found that the number of strings multiplied by the string tension (in pounds) should be between about 1300 pounds and 3200 pounds for oval headed rackets which have vertical strings, between about 1300 pounds and 2900 pounds for oval headed rackets which have horizontal strings, and between about 900 pounds and 2200 pounds for circular headed rackets which have either vertical or horizontal strings.

The reason for the variation in the product depending upon the type of head the racket has is related to the strength of the head which is determined by its shape. Thus, high tension with a high number of strings has been found to distort or collapse the head of a racket. On the other hand, an oval headed racket which has vertical strings is able to support a somewhat higher tension than an oval headed racket which has horizontal strings.

The nature of the stringing of rackets of the present invention has been found to create a "sweet spot" which encloses the entire head and which keeps a ball on the strings longer than the strings of a conventionally strung racket. In addition, the strings securely maintain their positions. Thus, rackets employing the present invention provide greater ball velocity with less effort on the part of the player and they enhance speed, spin, control, and accuracy.

It should be recognized by those skilled in the art that variations can be made without departing from the spirit or scope of the present invention. In particular, a racket can be constructed in which the spacing of the strings in each set varies such that the strings near the center of the head are closer together than those removed from the center of the head.

In addition, those skilled in the art will realize that while reference was made herein to oval headed tennis rackets and circular headed squash rackets, tennis rackets can be made with circular heads and squash rackets can be made with oval heads and the references herein were intended only to conform to the general custom rather than to imply that such custom was universally required by the invention.

Also, references to the stringing of rackets in accordance with the present invention referred to the use of awls to hold the tension on strings which have been placed in position. There are various machines available which do not require the use of awls, and the references made herein should be recognized by those skilled in the art to be exemplary rather than exclusive with respect to the manner in which rackets can be strung in accordance with the present invention.

I claim:

1. An improved racket of the type comprising a handle having an open head at one end, wherein the improvement comprises:

(a) a first set of substantially parallel strings substantially uniformly spaced across said head which strings are substantially parallel to the longitudinal axis of said handle;

(b) a second set of substantially parallel strings substantially uniformly spaced across said head which strings form a first angle with said first set of strings; and (c) a third set of substantially parallel strings substantially uniformly spaced across said head which form a second angle with said second set of strings, said second angle being substantially twice said first angle, said third set of strings forming an angle substantially equal to said first angle with said first set of strings, each of said strings in said second set underlying each of said strings in said third set and each of said strings in said first set underlying each of said strings in second set and overlying each of said strings in said third set, the strings in said first set intersecting the strings in said second set substantially midway between adjacent pair of strings in said third set, the strings in said second set intersecting the strings in said third set substantially midway between adjacent pair of strings in said first set and the strings in said first set intersecting the strings in said third set substantially midway between adjacent pair of strings in said second set.

2. The racket of claim 1 wherein the number of strings in said second set equals the number of strings in said third set.

3. The racket of claim 2 wherein said open head is oval in shape.

4. The racket of claim 3 wherein the number of strings in said first set is between 9 and 16.

5. The racket of claim 4 wherein the number of strings in said second set is between 9 and 20.

6. The racket of claim 5 wherein the product of the number of strings in said first, second, and third sets multiplied by the tension of said strings is between 1300 pounds and 3200 pounds.

7. The racket of claim 2 further comprising a substantially circular head.

8. The racket of claim 7 wherein the number of strings in said first set is between 9 and 16 and the number of strings in said second set is between 9 and 14.

9. The racket of claim 8 wherein the number of strings in said first set equals the number of strings in said second set and is between 9 and 14.

10. The racket of claim 9 wherein the product of the number of strings in said first, second, and third sets multiplied by the tension of said strings is between 900 pounds and 2200 pounds.

11. An improved racket of the type comprising a handle having an open head at one end, wherein the improvement comprises:

(a) string support means located about the head in a predetermined pattern;

(b) a first set of substantially parallel strings substantially uniformly spaced across said head which strings are substantially parallel to the longitudinal axis of said handle, said first set occupying a predetermined number of said string support means;

(c) a second set of substantially parallel strings substantially uniformly spaced across said head which strings form a first angle with said first set of strings, said second set occupying a predetermined number of said string support means;

(d) a third set of substantially parallel strings substantially uniformly spaced across said head which form a second angle with said second set of strings, said third set occupying a predetermined number of said string support means, said second angle being substantially twice said first angle, said third set of strings forming an angle substantially equal to said first angle with said first set of strings, each of said strings in said second set underlying each of said strings in said third set and each of said strings in said first set underlying each of said strings in said second set and overlying each of said strings in said third set;

(e) said predetermined pattern, the predetermined occupation of said string support means and the overlying and underlying stringing pattern being so designed that the strings in said first set intersect the strings in said second set substantially midway between adjacent pairs of strings in said third set, the strings in said second set intersect the strings in said third set substantially midway between adjacent pairs of strings in said first set, and the strings in said first set intersect the strings in said third set substantially midway between adjacent pairs of strings in said second set;

(f) the strings of each said sets being substantially straight; and (g) the number of strings in each of said sets being in the range of 9 to 20.

12. A method of stringing a racket comprising the steps of:

(a) providing a racket frame having a plurality of string support means distributed in a predetermined pattern around its head;

(b) stringing a first set of substantially parallel strings substantially uniformly spaced across the head in a direction substantially parallel to the longitudinal axis of the handle of the racket and with a predetermined tension;

(c) stringing a first pair of strings of a second set of substantially parallel strings substantially uniformly spaced in a direction to form a first angle with said first set, said first pair of strings starting in the central portion of the head and overlying said first set, said first pair of strings being held in a predetermined tension;

(d) stringing a second pair of strings of a third set of substantially parallel strings substantially uniformly spaced in a direction to form a second angle with said first pair of strings, said second angle being substantially twice said first angle, said second pair of strings forming an angle substantially equal to and opposite to said first angle with said first set, said second pair of strings starting in the central portion of the head and underlying the strings of said first set and overlying said first pair of strings, said second pair of strings being held in a predetermined tension;

(e) alternating stringing said first and second pairs of strings until the head is completely strung; and (f) said predetermined pattern and said stringing steps being chosen so that the strings of each set intersect substantially midway between adjacent pairs of parallel strings of the remaining sets of strings and each string is substantially straight.

13. A method in accordance with claim 12 in which the number of strings and predetermined tension in each of said sets is chosen so that the product of these is between 1300 and 3200 pounds.

14. An improved racket of the type comprising a handle having an open head at one end, wherein the improvement comprises:

(a) string support means located about the head in a predetermined pattern;

(b) a first set of substantially parallel strings substantially uniformly spaced across said head which strings are substantially parallel to the longitudinal axis of said handle, said first set occupying a predetermined number of said string support means;

(c) a second set of substantially parallel strings substantially uniformly spaced across said head which strings form a first angle with said first set of strings, said second set occupying a predetermined number of said string support means;

(d) a third set of substantially parallel strings substantially uniformly spaced across said head which form a second angle with said second set of strings, said third set occupying a predetermined number of said string support means, said second angle being substantially twice said first angle, said third set of strings forming an angle substantially equal to said first angle with said first set of strings, each of said strings in said second set underlying each of said strings in said third set and each of said strings in said first set underlying each of said strings in said second set and overlying each of said strings in said third set;

(e) said predetermined pattern, the predetermined occupation of said string support means and the overlying and underlying stringing pattern being so designed that the strings in said first set intersect the strings in said second set substantially midway between adjacent pairs of strings in said third set, the strings in said second set intersect the strings in said third set substantially midway between adjacent pairs of strings in said first set, and the strings in said first set intersect the strings in said third set substantially midway between adjacent pairs of strings in said second set;

(f) the strings of each of said sets being substantially straight.

* * * * *